US006419052B1

(12) United States Patent
Müller et al.

(10) Patent No.: US 6,419,052 B1
(45) Date of Patent: Jul. 16, 2002

(54) EQUIPMENT FOR CARRYING OUT OPERATIONS IN AN ELEVATOR SHAFT

(75) Inventors: Rolf Müller, Shizuoka (JP); Hanspeter Bloch, Buchrain (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 09/564,848

(22) Filed: May 4, 2000

(30) Foreign Application Priority Data

May 7, 1999 (EP) ..... 99810400

(51) Int. Cl.[7] ..... B66B 7/00
(52) U.S. Cl. ..... 187/414
(58) Field of Search ..... 187/414, 406, 187/408, 409; 52/30

(56) References Cited

U.S. PATENT DOCUMENTS 627,257 A * 6/1899 Haines et al.

FOREIGN PATENT DOCUMENTS

| | | |
|---|---|---|
| JP | 2-291377 | * 12/1990 |
| JP | 3-177284 | * 8/1991 |
| JP | 05097357 | 4/1993 |
| JP | 5-147845 | * 6/1993 |
| JP | 09077426 | 3/1997 |
| JP | 09086835 | 3/1997 |

* cited by examiner

*Primary Examiner*—Thomas J. Brahan
(74) *Attorney, Agent, or Firm*—MacMillan, Sobanski & Todd, LLC

(57) ABSTRACT

A maintenance trestle is stowable in folded-together form in the hatch cover of an elevator car. The maintenance trestle is erected by tilting the hatch cover into the car interior about a first fulcrum. The maintenance trestle is now accessible in folded-together form and includes transverse connectors. Several supports arranged in the car walls are pivotable into the car and are engaged by the transverse connectors. The transverse connectors carry plates forming a platform for supporting a person. Stays for stabilizing the maintenance trestle diagonally extend between the supports and the car floor.

13 Claims, 1 Drawing Sheet

EQUIPMENT FOR CARRYING OUT OPERATIONS IN AN ELEVATOR SHAFT

BACKGROUND OF THE INVENTION

The present invention relates to equipment for carrying out operations in an elevator shaft, in which an elevator car with a maintenance trestle, from which the operations can be performed, is movable.

Equipment for the servicing of shaft equipment of an elevator installation is shown in the Japanese patent specification 05097357. A platform which is tiltable out of the car wall and serves as a standing surface for the engineer during servicing operations is provided in an elevator car. Provided in the roof of the elevator car is a hatch which is closable by means of a cover and which affords access to the shaft equipment. The engineer stands up on the platform and can carry out the operations in the shaft with his upper body protruding out of the car.

A disadvantage of the known equipment resides in the fact that the car wall supporting the platform has to be mechanically reinforced and in addition fittings for the tilting and fixing of the platform are necessary, at which the elevator users can be caught by articles of clothing or objects, because the platform is disposed in the standing region of the elevator users.

SUMMARY OF THE INVENTION

The present invention concerns an elevator car movable in an elevator shaft and including a plurality of side walls extending between a floor and a ceiling to form a car interior, the ceiling having a hatch formed therein closed by a movable hatch cover for access to an elevator shaft from the interior, and a support means attached to the side walls. A maintenance trestle is folded and stored in the hatch cover and has a platform for supporting a person, whereby when the hatch cover is moved to an open position, the maintenance trestle is accessible. When the maintenance trestle is unfolded and engaged with the support means, the platform is in an erected position in the car interior and a person standing on the platform in the erected position can reach through the hatch and carry out operations in the elevator shaft in which the elevator car travels.

The maintenance trestle includes transverse connectors engaging the support means and supporting said platform in the erected position. The maintenance trestle also includes stays extending from the support means to the floor of the elevator car for stabilizing the platform in the erected position. The transverse connectors and the stays can be telescopic or foldable.

The present invention meets the object of avoiding the disadvantages of the known equipment and of creating equipment for operations in an elevator shaft, which equipment does not represent a risk either for the engineer or for the elevator users in the elevator car.

The advantages achieved by the invention are essentially that there is no risk for the elevator car users of injury on parts of the maintenance trestle, because the maintenance trestle is located outside the standing region of the elevator car users. The car interior is not adversely affected by the maintenance trestle. In terms of selling strategy the aesthetic presentation of the car interior is of great economic significance.

The maintenance trestle according to the invention completely and entirely meets this requirement, for example by the invisible arrangement of the maintenance trestle.

The maintenance trestle according to the invention also has an increased load bearing capability, so that parts to be mounted or demounted in the shaft can be intermediately placed on the maintenance trestle. The position of the hatch or the ceiling opening in the roof of the elevator car can be so selected for the performance of operations in the elevator shaft that the hatch is not overlapped by shaft equipment arranged in the shaft head, wherein in this case the maintenance trestle lies in the projection of the hatch and moreover has a sufficiently large standing area. The position of the hatch, the sufficient standing area and the increased load-bearing capability of the maintenance trestle guarantee the safety of the engineer. Moreover, the maintenance trestle is extremely simple in operation and is quickly ready for use without effort.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
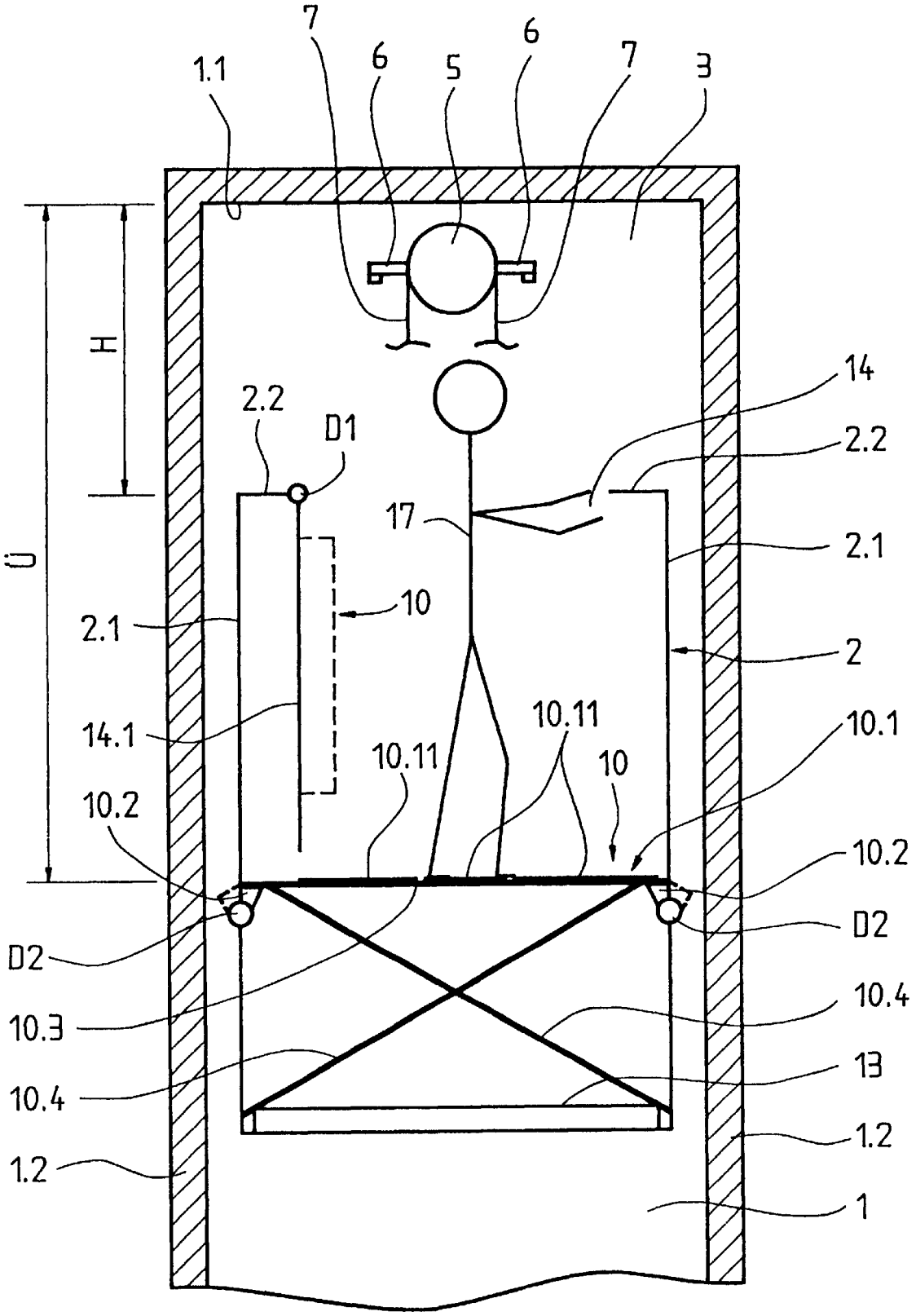
FIG. 1 is a schematic illustration of an elevator car that has a maintenance trestle according to the present invention, which car is stopped at the top stopping point in an elevator shaft with shortened shaft head.

An elevator shaft 1, in which an elevator car 2 is movable, is bounded by shaft walls 1.2. A drive pulley 5, which is connected with a drive that is not illustrated, is arranged in the shaft head 3. The drive pulley 5 and/or the drive is supported by, for example, a wall bracket 6 attached to one of the shaft walls 1.2. A carrying cable 7 has a cable course which is not illustrated, for example from a fixed point over a deflecting roller of the elevator car 2 or, in the case of a looping underneath, over two deflecting rollers, further over the drive pulley 5, further over a deflecting roller of a counterweight which is not illustrated and further to a further fixed point. The elevator car 2 includes a plurality of side walls 2.1 extending between a ceiling 2.2 and a floor 13 to form a car interior.

A maintenance trestle 10 is arranged in the elevator car 2 and serves for the maintenance of elevator equipment, such as, for example, the drive pulley 5, a drive, the support cable 7, guide rails, elevator switches, etc. A standing area from which the operations in the elevator shaft 1 are carried out is provided in the form of a platform 10.1. For the transport of persons and goods, the maintenance trestle 10 is stowed (shown in dashed lines) at a hatch cover 14.1 closing a hatch 14 in the car ceiling 2.2. For maintenance operations in the elevator shaft 1, the maintenance trestle 10 can be erected as shown in FIG. 1.

The maintenance trestle 10 is stowable in folded-together form at the hatch cover 14.1 as shown by dashed lines. The hatch cover 14.1 is hinged to the car ceiling 2.2 at an edge adjacent the edge of the hatch 14 opening. To erect the maintenance trestle 10, the hatch cover 14.1 is tilted about a first fulcrum D1 into the interior of the elevator car 2. The maintenance trestle 10 is now accessible, in folded-together form, for erection. The car walls 2.1 are utilized to support parts of the maintenance trestle 10. Initially, several supports 10.2 arranged in the car walls 2.1 are pivoted into the elevator car 2 in an extended position and, for example, include telescopic or foldable transverse connectors 10.3.

The transverse connectors 10.3 carry plates 10.11 forming the platform 10.1. For stabilizing the maintenance trestle 10, for example, diagonally extending and telescopic or foldable stays 10.4 are arranged between the supports 10.2 and the car floor 13.

The supports 10.2 are pivotable about a second fulcrum D2. When persons and goods are being transported in the elevator car 2, the supports 10.2 are in a retracted position, which is shown in dashed lines, outside the elevator car 2.

In the case of elevator cars 2 with handrails, the handrails can be used as supports for the transverse connectors 10.3. The supports 10.2 shown in FIG. 1 are not necessary in this variant embodiment; the remaining parts of the maintenance trestle 10 remain the same as explained above.

The hatch 14, which is closable by means of the hatch cover 14.1, is provided in the ceiling 2.2 of the elevator car 2. As shown in the FIG. 1, the hatch cover 14.1 is tiltable about the first fulcrum D1, but it can also be constructed as a removable hatch cover.

The position and the size of the hatch 14 are so selected that the hatch is not overlapped by shaft equipment, such as, for example, the drive pulley 5 and/or by the drive, arranged in the shaft head 3. The shown elevator disposition, without a machine room and with its shortened shaft head 3, offers an insufficient height H for the maintenance of the car roof for a prescribed over-travel (distance between the car ceiling 2.2 and the shaft ceiling 1.1) of, for example, one meter. With the maintenance trestle 10 according to the present invention, in the shown working setting, the safety of an engineer 17 standing on the platform 10 is taken care of and the required over-travel Ü distance is achieved, because the distance between the car ceiling 2.2 and the shaft ceiling 1.1 is no longer determinative, but rather the distance between the platform 10.1 and the shaft ceiling 1.1 is determinative, and because no shaft equipment in the shaft head 3 overlaps the hatch 14.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. Equipment for carrying out operations in an elevator shaft in which an elevator car is movable, the car including side walls extending between a floor and a ceiling forming a car interior, the ceiling having a hatch therein for accessing the elevator shaft from the car interior, comprising: a maintenance trestle having a platform for supporting a person in an elevator car in an erected position, said maintenance trestle being foldable for storage in the elevator car and can be unfolded into engagement with side walls of the elevator car in an erected position in the car interior from which a person standing on said platform can reach through the hatch in the car ceiling and carry out operations in an elevator shaft in which the elevator car travels.

2. The equipment according to claim 1 including support means adapted to be mounted to the side walls of the elevator car for supporting said platform.

3. The equipment according to claim 2 wherein said support means includes supports pivotal from the side walls into the interior of the elevator car for supporting said platform.

4. The equipment according to claim 2 wherein said support means includes handrails attached to the side walls of the elevator car for supporting said platform.

5. The equipment according to claim 2 wherein said maintenance trestle includes transverse connectors for engaging said support means and supporting said platform.

6. The equipment according to claim 5 wherein said transverse connectors are one of telescopic and foldable.

7. The equipment according to claim 2 wherein said maintenance trestle includes stays extending from said support means to a floor of the elevator car for stabilizing said platform.

8. The equipment according to claim 7 wherein said stays are one of telescopic and foldable.

9. The equipment according to claim 1 wherein said maintenance trestle is foldable for storage on a hatch cover of the elevator car.

10. An elevator car movable in an elevator shaft, comprising:

a plurality of side walls extending between a floor and a ceiling to form a car interior, said ceiling having a hatch formed therein closed by a movable hatch cover for access to an elevator shaft from the interior;

a support means attached to said side walls on opposite sides of said car interior; and a maintenance trestle folded and stored on said hatch cover and having a platform for supporting a person, whereby when said hatch cover is moved to an open position, said maintenance trestle is accessible, and when said maintenance trestle is unfolded and engaged with said support means, said platform is in an erected position extending between said opposite sides of said car interior and a person standing on said platform in the erected position can reach through said hatch and carry out operations in the elevator shaft in which the elevator car travels.

11. The elevator car according to claim 10 wherein said maintenance trestle includes transverse connectors engaging said support means and supporting said platform in the erected position.

12. The equipment according to claim 11 wherein said maintenance trestle includes stays extending from said support means to said floor of said elevator car for stabilizing said platform in the erected position.

13. The equipment according to claim 12 wherein said transverse connectors and said stays are one of telescopic and foldable.

* * * * *